United States Patent [19]

Looker

[11] Patent Number: 5,014,630

[45] Date of Patent: May 14, 1991

[54] CREMATOR

[76] Inventor: Steve Looker, 2271 Ashbury Dr., Clearwater, Fla. 34624

[21] Appl. No.: 501,644

[22] Filed: Mar. 29, 1990

[51] Int. Cl.[5] ..... F23G 1/00

[52] U.S. Cl. ..... 110/194; 110/235; 110/212

[58] Field of Search ..... 110/194, 235, 211, 212

[56] References Cited

U.S. PATENT DOCUMENTS

| | | | |
|---|---|---|---|
| 1,497,371 | 6/1924 | Gibbon | 110/194 |
| 3,538,864 | 11/1970 | Segrest | 110/194 |
| 4,321,878 | 3/1982 | Segrest | 110/194 |
| 4,603,644 | 8/1986 | Brookes | 110/194 |

FOREIGN PATENT DOCUMENTS

| | | | |
|---|---|---|---|
| 8909912 | 10/1989 | World Int. Prop. O. | 110/194 |

*Primary Examiner*—Edward G. Favors

*Attorney, Agent, or Firm*—Joseph C. Mason; Ronald E. Smith

[57] ABSTRACT

A cremator having a parallelepiped construction of increased lateral breadth relative to earlier cremators. The hot gases flowing through the apparatus are constrained to follow a serpentine path of travel below the plane of the primary hearth that includes two return bends. Thus, the path of travel is elongated and the dwell time of the gases within the apparatus is increased. The gases are re-heated after the first return bend has been traversed, and the velocity of the flow of gases is further decreased by increasing the cross sectional area of the passageways that contain the gas flow.

19 Claims, 4 Drawing Sheets

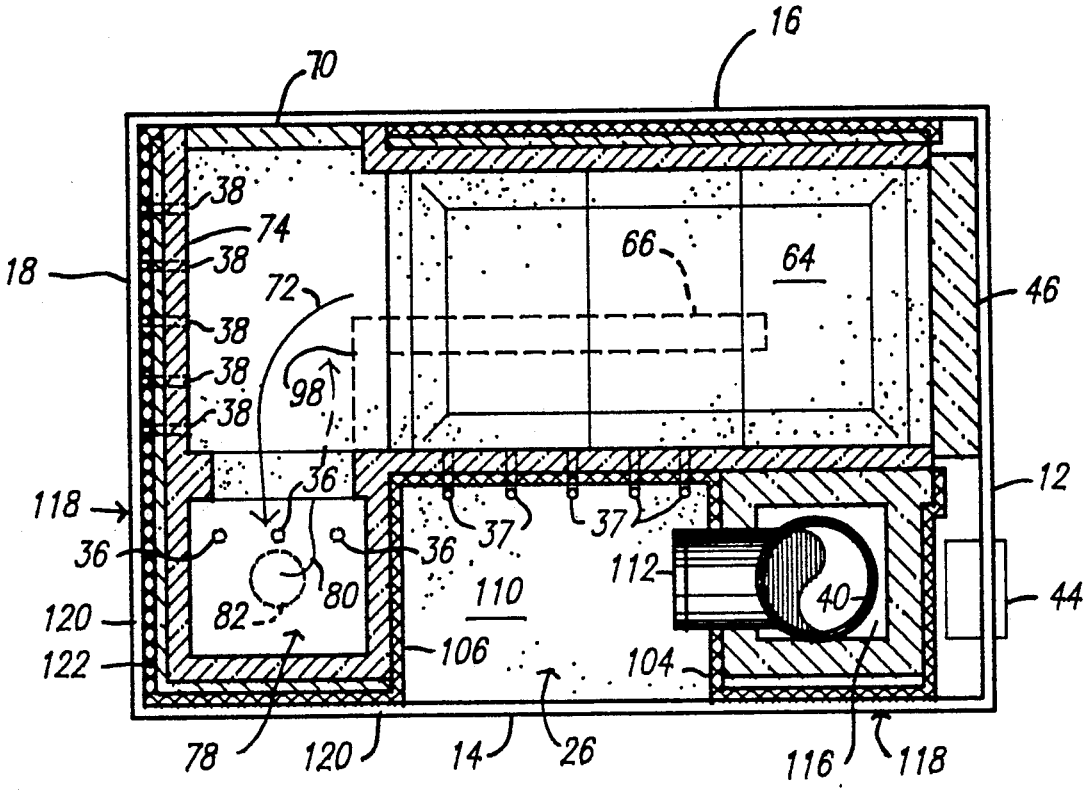
FIG. 4
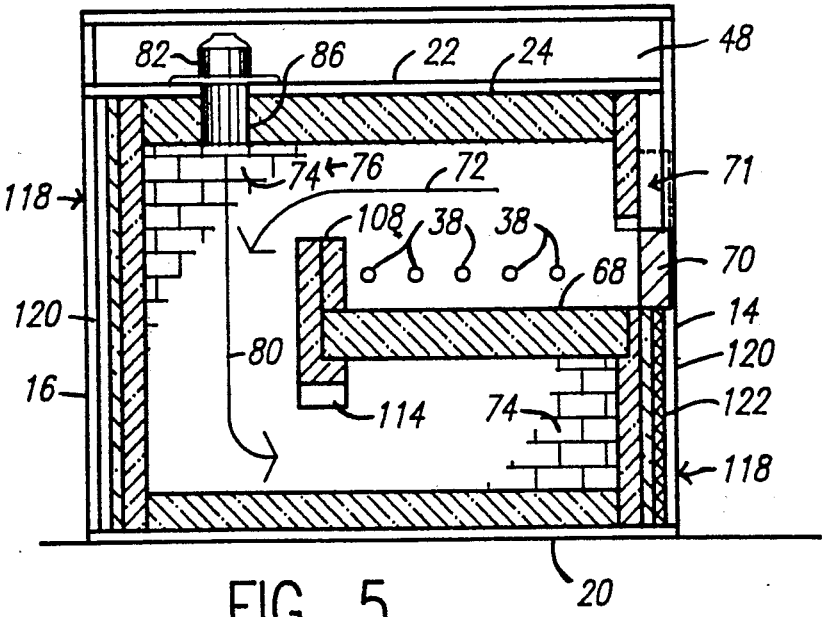
FIG. 5
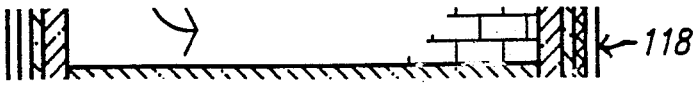

CREMATOR

TECHNICAL FIELD

This invention relates, generally, to incinerators or cremators. More particularly, it relates to a cremator that constrains gases flowing therethrough to follow a serpentine path of travel.

BACKGROUND ART

In Europe, about ninety percent of the population chooses cremation over burial. In the U.S., the percentage is lower, but rising each year.

The cremators currently in use include a cremation burner positioned in the primary chamber to combust the casket and remains which are supported by a hearth. The burner is fired almost continuously throughout the cremation process. The gases flow from the primary chamber to an afterburningarea where they are reburned, and thereafter follow a predetermined path of travel to a chimney. Typically, the path of travel is a simple "U"-shaped path, i.e., the gases flow from the afterburner area at the trailing end of the hearth to the leading end of the hearth, execute a single return bend, and flow back to the trailing end of the hearth and hence to the chimney.

Perhaps the most advanced cremator of the prior art is shown in U.S. Patent No. 4,603,644 to Brookes. In the Brookes device, the hot gases follow a path of travel that begins at a primary ignition burner positioned above the horizontal hearth at a leading end thereof, and extends therefrom to a trailing end of the hearth, over an ash trough at a trailing end of the hearth, into an afterburner passageway where the gases flow downwardly to a plane below the hearth and ash trough, toward the leading end of the hearth while in said plane below said hearth, through a return bend and toward the trailing end of the hearth to a chimney. Thus, the path of travel of the gases below the hearth includes a single return bend. As a consequence, the temperature of the gases becomes increasingly difficult to maintain. Recent Environmental Protection Agency regulations require that hot gases flowing through cremators must dwell therewithin for at least a full second, at 1800 F.

In the Brookes device, and other earlier devices, the gases flowing below the hearth begin to cool as they leave the afterburner area, i.e., by the time the gases execute the return bend at the leading end of the cremator, and travel the length of the hearth and ash trough to the chimney, said gases will have cooled considerably as there are no further re-heating means.

The prior art, considered as a whole, neither teaches nor suggests how the dwell time could be increased, or how the gases could be reheated to maintain a constant ideal combustion temperature.

DISCLOSURE OF INVENTION

The need for a cremator apparatus having an increased dwell time and means for re-heating the gases as they travel through the afterburning chamber is fulfilled by a cremator apparatus that is approximately one-third wider than the devices of the prior art. The increased lateral extent of the apparatus and a unique structural arrangement of parts provides a serpentine path of travel for the hot gases below the common plane of the hearth and ash trough; the path of travel includes two reverse bends and as such is an elongated path of travel vis a vis the paths of the prior art devices. Moreover, the passageways through which the gases travel have increased cross sectional areas vis a vis the passageways of the prior art devices, thereby enabling the gases to flow at a slower velocity, and thereby again increasing their dwell time within the device.

Importantly, after the gases have made the first return bend, they flow toward the trailing end of the device where the afterburner is positioned, and are thus re-heated through a common wall as they approach the second return bend and as they execute the second return bend. The afterburner area is the hottest part of the apparatus and as a result, the gases are substantially re-heated after making said first return bend.

It is an important object of this invention to provide a cremator apparatus that constrains gases flowing therethrough to remain therewithin for a substantial amount of time at a constant temperature.

An important object is also to provide such an apparatus that re-heats the gases during their travel within the secondary chamber to insure complete combustion prior to their exit from the device.

Still another major object is to provide such an apparatus having relatively slow velocitygases flowing therethrough.

Another objective is to reclaim the otherwise wasted afterburner heat through common walls and hearth in order to eliminate the need for the primary chamber burner, once the unit is up to a running temperature of 1800 degrees F.

These and other objects and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 4 is a sectional view taken along line 4—4 in FIG. 2;

FIG. 5 is a sectional view taken along line 5—5 in FIG. 2;

Similar reference numerals refer to similar parts throughout the several views of the drawings.

BEST MODES FOR CARRYING OUT THE INVENTION

Figure 1:
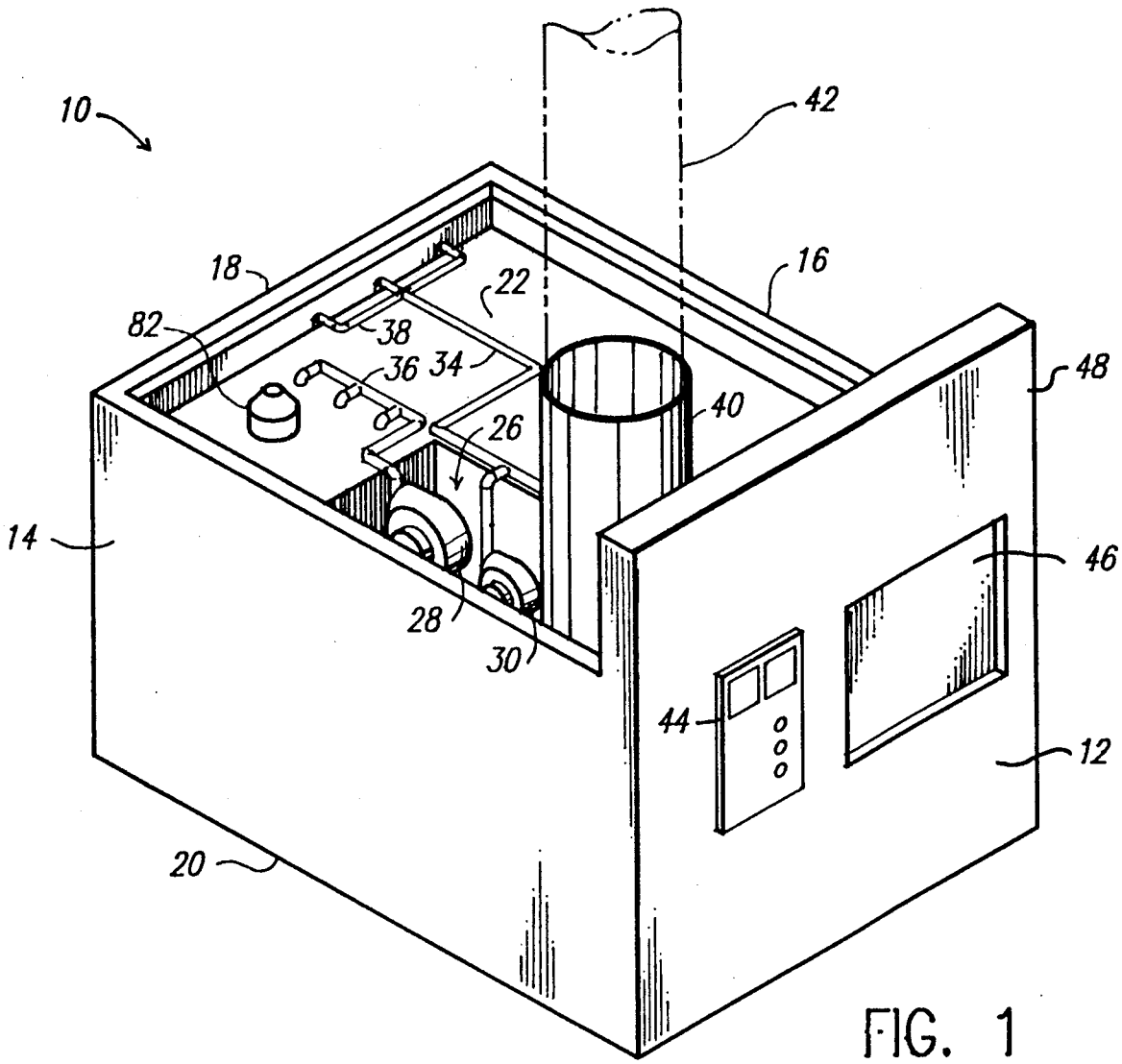
FIG. 1 is a perspective view of the novel cremator, with a top wall thereof removed to show certain structural parts.
Figure 6:
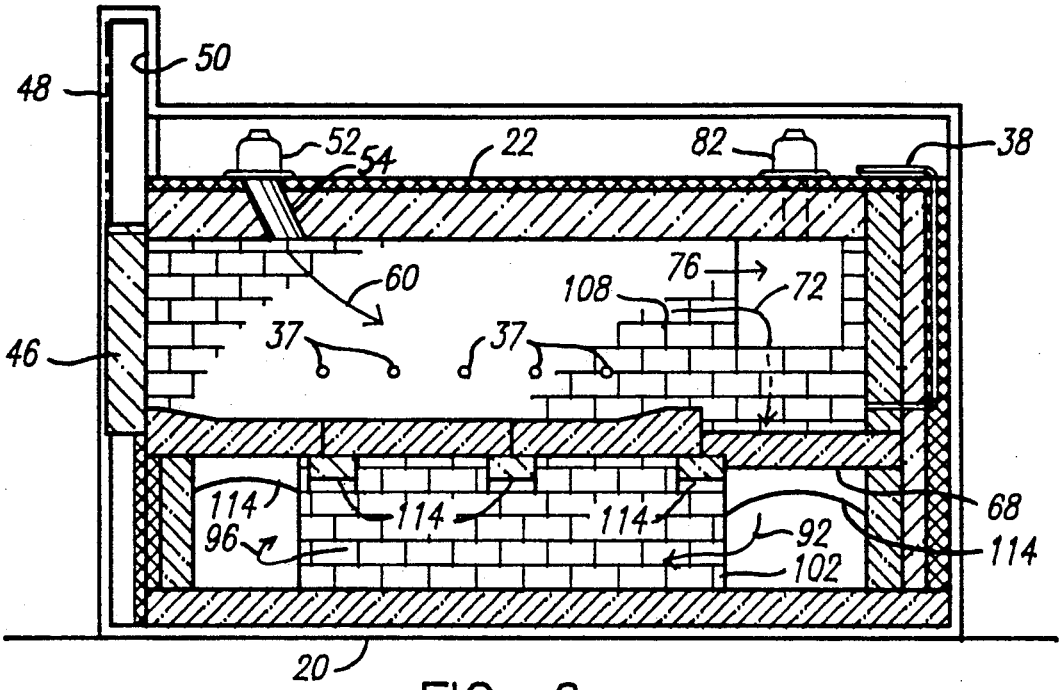
FIG. 6 is a sectional view taken along line 6—6 in FIG. 3.
Figure 7:
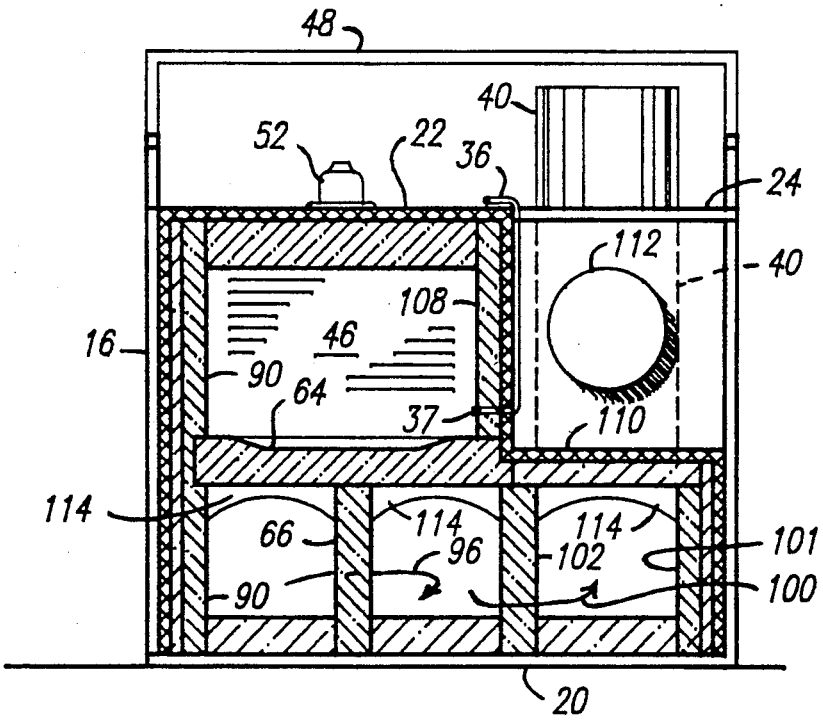
FIG. 7 is a sectional view taken along line 7—7 in FIG. 2.

The novel cremator is denoted as a whole in FIG. 1 by the reference numeral 10. It will there be seen that it includes a front wall 12, side walls 14, 16, back wall 18 and a bottom wall 20. Top outer wall 22 is positioned two inches above top inner wall 24, as best shown in FIG. 5, to provide an insulating air space therebetween. A warm (about 200 degrees Fahrenheit) air chamber 26 is also shown in FIG. 1. A pair of air blowers 28, 30 are positioned in chamber 26 as shown; blower 28 blows warm air from chamber 26 into the after burner passageway of the device through manifold 36 and air blower 30 blows warm air from chamber 26 to various preselected parts of the device to provide additional air for combustion through a manifold system denoted 34 as a whole. System 34 includes a first section 38 for supplying extra combustion air to the secondary reduction zone as best shown in FIGS. 4 and 5 and a second section 37 for supplying warm air to the hearth area, as shown in FIGS. 4, 6 and 7.

Chimney 40, which may have extension 42, is positioned at the forward or leading end of the device as shown. Control panel 44 provides information to the operator of the cremator; it is essentially conventional and does not form a part of the invention, per se.

Slideably mounted entrance door 46 is received within a hollow extension 48 of front wall 12. More particularly, door 46 slides upwardly into extension 48; the extension of front wall 12 above the control panel 44 is provided to simplify construction and for aesthetics. The transverse extent of unit 10 is about one-third greater than that of prior art cremators, and its longitudinal extent is somewhat greater as well.

Figure 2:
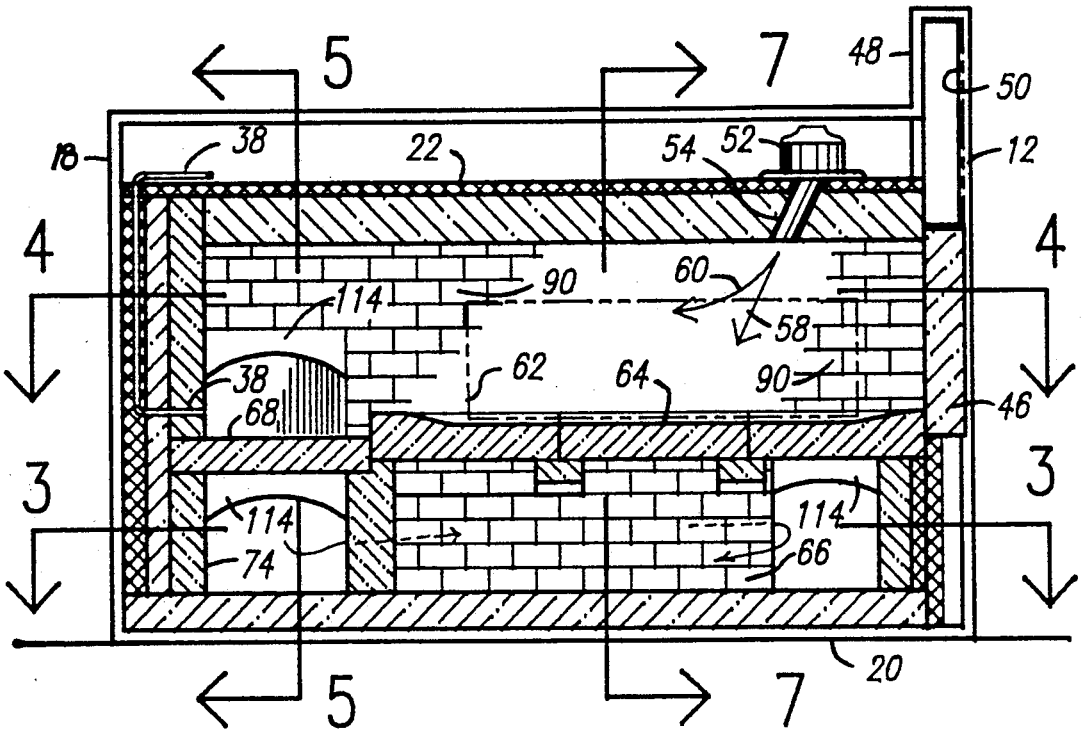
FIG. 2 is a longitudinal sectional view taken along lines 2—2 in FIG. 3.

Cremator 10 is shown in longitudinal section in FIG. 2. The hollow interior 50 of front wall section 48 that slideably receives entrance door 46 is there shown, together with many other structural features of the unit.

Main ignition burner 52 is mounted by suitable means atop outer top wall 22 as shown and has rearwardly inclined nozzle 54 that extends through the air plenum between said outer top wall 22 and inner top wall 24, and hearth top wall 56, which is made of ceramic fiber. A flame is thus directed downwardly and rearwardly as indicated by directional arrow 58; hot gases, accordingly, flow toward the rear or trailing wall 18 of the unit as denoted by the directional arrow 60. An interlocking means disposed between door 46 and ignition burner 52 interrupts operation of said burner 52 when door 46 is open.

Phantom lines 62 indicate a casket that is placed atop hearth 64 in that part of the unit known as the cremation chamber; hearth 64 is made in three sections as depicted and is of a monolithic castable material.

A longitudinally extending wall 66 supports hearth 64 along a substantial part thereof along its longitudinal axis of symmetry. Wall 66 is shown in FIG. 2 but its central positioning relative to hearth 64 is perhaps best understood in connection with FIGS. 4 and 7.

A secondary reduction hearth 68 is positioned rearwardly of hearth 64, slightly downwardly therefrom as shown. After casket 62 and the body therein have been partially incinerated upon hearth 64, the wood from the casket becomes charcoal because the combustion at this part of the procedure has taken place in an oxygen-starved environment. Accordingly, after the operator has determined that the primary reduction process is completed, entrance door 46 is opened slightly and a push rod, not shown, is used to push the charcoal and all other incinerated remains onto the secondary reduction hearth 68. Immediately thereafter, a second casket is loaded onto the primary hearth 64; thus, the unit can be operated continuously.

The drop off at the trailing end of primary hearth 64 down to secondary hearth 68 insures that the incinerated remains on the secondary hearth 68 will not admix with the after-loaded casket. When the operator determines that the secondary reduction is complete, a remains removal door 70 (FIG. 4) is opened upwardly into cavity 71 (FIG. 5) to collect the remains from secondary hearth 68 for collection into a tray, said collection taking place before the remains of the next casket 62 is pushed onto the secondary hearth 68.

The longitudinal extent of secondary hearth 68 is worthy of note; it is greater than that of prior art secondary hearths and thus insures against unwanted mixing of remains. It should also be observed in FIG. 2 that manifold pipes 38 deliver warm air to the secondary reduction zone in order to oxidize the charcoal, i.e., the secondary reduction zone is at times not an oxygen-starved environment.

Reference should now be made to FIG. 4. Directional arrow 72 indicates the path of travel of the hot gases flowing over primary hearth 64 in a rearwardly direction and the right angle turn those gases are constrained to make upon encountering inner rear wall 74. A similar directional arrow, also denoted 72, appears in FIG. 5. The gases next travel through opening 76 into afterburner passageway 78, and are driven downwardly as best indicated by directional arrow 80 in FIG. 5; a similar arrow denoting the same path of travel appears in FIG. 4 as well.

The downward path of travel is caused by afterburner 82 (FIG. 5) and its downwardly directed nozzle 86, and draft caused by stack 40. Afterburner 82 is a high to low fire or modulating afterburner.

Figure 3:
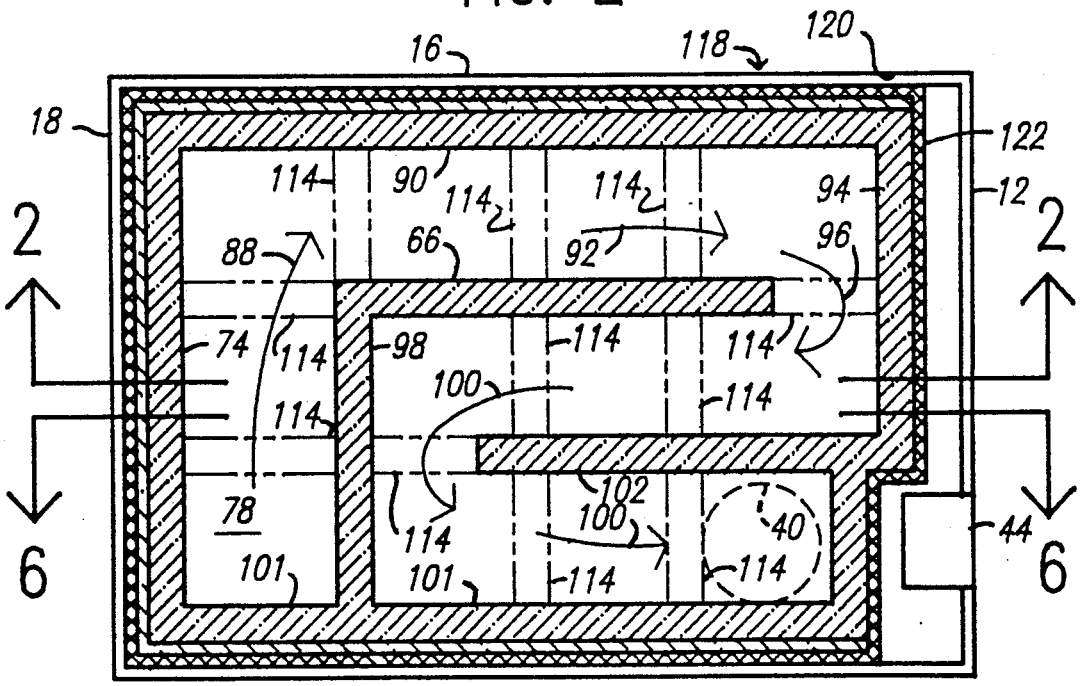
FIG. 3 is a sectional view taken along line 3—3 in FIG. 2.

The downwardly flowing gases are next constrained, as best shown in FIG. 3, to flow under the secondary reduction hearth 68 as indicated by arrow 88 in that FIG. This is an advantageous path of travel because afterburner passageway 78 is the hottest part of the entire unit. Accordingly, as these very hot gases flow under secondary reduction hearth 68, the desired secondary reduction is easily accomplished in the absence of auxiliary burners.

Inner side wall 90 next constrains the gases to turn, as indicated by said arrow 88, toward the leading or front end of the unit. The flow indicated by arrow 92 carries the gases underneath the primary hearth 64; importantly, hearth 64 is not made of an insulating material. Correspondingly, the gases flowing as indicated by said arrow 92 are themselves still hot, having just exited the afterburner passageway and thus serve to heat the primary hearth to insure a good combustion of the items thereatop, thereby limiting the need for continuous operation of ignition burner 52.

Front inner wall 94 then constrains the gases to execute a first return bend as indicated by arrow 96. This directs the gases back toward the afterburner passageway area 78 again, thereby re-heating said gases. Transverse wall 98 constrains the gases to execute a second return bend 100 immediately adjacent the afterburner passageway, thereby elevating the temperatures thereof by a substantial extent, thereby ensuring complete combustion, before the gases flow to chimney 40.

Hearth support wall 66, transverse wall 98 and inner longitudinal wall 102 are also formed of non-insulating material since heat transfer therethrough is desirable.

It should therefore be understood that the gases follow a very long path of travel inside unit 10, including an elongate serpentine path of travel. More particularly, the path of travel begins at or near the front of the primary hearth, flows longitudinally through the cremation chamber toward the rear or trailing end of the cremator, makes a first transverse turn upon encountering the transversely extending inner rearward wall of the unit, travels over the secondary reduction hearth, continues its transverse travel into the afterburner passageway, travels vertically downwardly through said passageway, flows transversely below the secondary hearth in a direction opposite to said first transverse flow, turns forwardly upon encountering a longitudinally extending side wall of the unit, flows longitudinally toward the front of the unit beneath the outer half of the primary hearth in a direction opposite to said first longitudinal direction of flow, executes a first return bend at the forward end of the unit, travels longitudinally under the inner half of the primary hearth in the same direction as the first longitudinal flow, executes a second return bend near the afterburner passageway and flows longitudinally back toward the chimney. The total amount of time required for a single molecule of gas to traverse this lengthy path of travel is well in excess of one second, at 1800 F., thereby meeting or exceeding applicable Environmental Protection Agency requirements Warm air chamber 26, as perhaps best shown in FIG. 4, is bounded at its forwardmost end by transverse chimney wall 104, at its trailing end by transverse afterburner passageway 106, along its outside by side wall 14, and along its inside by partition wall 108 which separates it from the cremation chamber. The bottom wall 110 of chamber 26 is the upper wall of the final passageway to chimney 40, indicated by arrow 100 in FIG. 3. The top wall 24 of chamber 26, as shown in FIG. 7, is coplanar with inside top wall 24 of unit 10. Thus, it should be understood that chamber 26 is the only part of the unit through which hot gases do not flow. However, since hot gases do flow beside and under it, the air therewithin will be heated to about 200 degrees Fahrenheit. Advantageously, this warm air is distributed to various parts of the unit as shown in part and as mentioned earlier in connection with FIG. 1.

The warm air is distributed to the afterburner passageway as at 36 as above-mentioned, to the secondary reduction area 38 as above-mentioned and also through plural ports, collectively denoted 37, as best shown in FIG. 4, to supply combustion air to the cremation chamber. However, the combustion air is not supplied throughout the entire cremation process, i.e., blower 30 is activated only when the operator determines that the oxygen-starved primary combustion process has been completed. The entire cremation process takes about one hour, and roughly half of that is carried on under oxygen-starved conditions and the second half thereof is carried on with both blowers operating.

FIG. 4 also depicts a swing action damper member 112 that acts a valve relative to chimney 40, i.e, as damper 112 is opened, the effective draft of chimney 40 is decreased. In the novel cremator 10, damper 112 is a servomechanism under the control of barometric pressure. Thus, the damper closes to increase the volumetric flow of gases through the chimney as the barometric pressure falls, and vice versa.

The primary and secondary hearths and floor 110 of chamber 26 are supported at longitudinally spaced intervals by a plurality of arches, collectively denoted 114 in FIG. 3 and other FIGS.

The materials used in the novel cremator, to be known commercially as the "Phoenix 4," are carefully selected to enhance the efficiency of the unit. Both the primary and secondary hearths are made of a dense castable and the chimney is formed of a lightweight insulated castable. A lightweight insulation 116 (FIG. 4) is supported by ten gauge steel to form chimney 40.

The veneer 118 (FIG. 4) of the unit is metallic, preferably stainless steel, and an air space or plenum chamber 20 circumscribes the unit 10 to provide the final insulation so that the exterior surface 118 of the unit is not hot even when the unit is operating. An insulating board 122 lines the entire lower part of the unit, as best depicted in FIG. 3. As also best understood in connection with FIG. 3, rear inner wall 74, inner side walls 90 and 101, inner forward wall 94, and the partition walls 66, 98 and 102 are all formed of heavy duty, dense firebrick. This type of fire brick is durable but non-insulating; once heated it stays heated, i.e., it radiates heat and helps maintain the high internal temperatures desired. The main and secondary hearths are also non-insulating for heat radiation.

The presence of the heat retaining firebrick and castable enables the shut down of the primary burner and the modulation of the afterburner throughout a large percentage of the cremation process, i.e., due to the radiated heat, the afterburner need not operate at full fire all the time, thereby saving fuel. The shut down of the ignition or primary burner is made possible by the heat supplied by the dense firebrick and hearth.

Those skilled in the art of cremator construction will appreciate that this invention is new, useful, and was not obvious to those of ordinary skill in the art at the time it was made, in view of the prior art, taken as a whole. Moreover, they will recognize this major invention as a pioneering improvement in this art. Due to the breakthrough nature of this invention, the claims that follow are to be broadly interpreted so as to protect the heart of this invention, as a matter of law.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. A cremator apparatus, comprising:

an upper chamber;

a lower chamber;

a passageway providing fluid communication between said upper chamber and said lower chamber;

an afterburner being disposed at an upper end of said passageway and said afterburner being operative to drive gases in said upper chamber to flow downwardly into said lower chamber;

a primary hearth;

said primary hearth defining, at least in part, a bottom wall of said upper chamber and, at least in part, a top wall of said lower chamber;

a secondary hearth;

said secondary hearth defining at least in part, a bottom wall of said upper chamber and, at least in part, a top wall of said lower chamber;

said secondary hearth being positioned at a trailing end of said primary hearth and being disposed in a plane parallel to and slightly downwardly of a plane of said primary hearth;

said primary hearth being supported along at least a part of its longitudinal axis of symmetry by a longitudinally extending support wall;

said upper chamber including a warm air chamber;

said warm air chamber being positioned between said afterburner passageway that interconnects said upper and lower chambers and a chimney; and a partition wall in said upper chamber that separates said warm air chamber from a cremation chamber including said primary hearth.

2. The apparatus of claim 1, further comprising at least one air blower positioned in said warm air chamber and further comprising a manifold for distributing warm air from said warm air chamber to preselected areas of said apparatus.

3. The apparatus of claim 2, wherein said preselected areas of said apparatus includes said afterburner passageway, an area adjacent said secondary hearth and an area over said primary hearth.

4. The apparatus of claim 3, further comprising a primary ignition burner in open fluid communication with said cremation chamber, an entrance door positioned at a leading end of said apparatus in registration with said cremation chamber, and interlocking means for interrupting operation of said primary ignition burner when said entrance door is open.

5. The apparatus of claim 4, further comprising a remains removal door positioned in a side wall of said apparatus at a trailing end thereof, said remains removal door being transversely spaced apart from said vertical afterburner passageway.

6. A cremator apparatus, comprising:

an upper chamber;

a primary combustion chamber disposed within said upper chamber;

a lower chamber;

a chimney means confluent with said lower chamber;

an afterburner passageway that provides fluid communication between said upper and lower chambers;

a warm air chamber;

said warm air chamber being positioned in heat-receiving relation to said primary combustion chamber and said afterburner passageway;

a substantially horizontally disposed primary hearth that, at least in part, partitions said upper chamber from said lower chamber; and blower means operative to move warm air from said warm air chamber into at least one preselected area of said apparatus;

whereby said warm air enhances the combustion process that occurs in said at least one preselected area of said apparatus.

7. The apparatus of claim 6, further comprising a secondary hearth positioned at a trailing end of said primary hearth, said secondary hearth being disposed in a plane parallel to and slightly offset downwardly from a plane of said primary hearth.

8. The apparatus of claim 7, further comprising a longitudinally extending support wall for supporting said primary hearth, said support wall being disposed in said lower chamber and having a longitudinal extent less than the longitudinal extend of said primary hearth so that combustion gases are constrained to execute a return bend when flowing below said primary hearth in route to said chimney means.

9. The apparatus of claim 8, wherein said at least one preselected area of said apparatus includes said afterburner passageway, an area adjacent said secondary hearth, and an area over said primary hearth.

10. The apparatus of claim 9, further comprising a primary ignition burner in open fluid communication with said cremation chamber, an entrance door positioned at a leading end of said apparatus in registration with said cremation chamber, and interlocking means for interrupting operation of said primary ignition burner when said entrance door is open.

11. The apparatus of claim 10, further comprising a remains removal door positioned in a side wall of said apparatus at a trailing end thereof, said remains removal door being transversely spaced apart from said vertical afterburner passageway.

12. A cremator apparatus, comprising:

an upper chamber;

a primary combustion chamber being positioned in said upper chamber;

a primary hearth being positioned in said primary combustion chamber;

a secondary combustion chamber being positioned in said upper chamber;

a secondary hearth being positioned in said secondary combustion chamber;

said secondary hearth being positioned at a trailing end of said primary hearth;

a lower chamber positioned below said upper chamber;

a chimney means in fluid communication with said lower chamber that enables hot gases to escape from said lower chamber;

a vertically oriented passageway providing fluid communication between said secondary combustion chamber and said lower chamber;

an afterburner disposed at an upper end of said passageway;

guide means constraining hot gases within said apparatus to flow under said secondary hearth and to thereafter execute at least two return bends before said hot gases escape said apparatus through said chimney means;

means for increasing the temperature of said hot gases after said hot gases have executed at least one return bend;

said means for increasing the temperature of said hot gases including said guide means, said guide means constraining said hot gases after executing said at least one return bend to flow toward said afterburner and said secondary combustion chamber;

said guide means constraining said hot gases to execute said second return bend in the vicinity of said passageway and said secondary combustion chamber to thereby reheat said hot gases.

13. The cremator of claim 12, wherein said apparatus further comprises:

a longitudinally extending support wall positioned in supporting relation to said primary hearth;

a transversely disposed wall being positioned in said lower chamber;

said support wall for said primary hearth having a trailing end integrally formed with said transversely disposed wall and a leading end disposed in longitudinally spaced relation to a leading end wall of said lower chamber so that said hot gases execute a first return bend at said leading end of said support wall;

a longitudinally extending wall, positioned in said lower chamber, parallel to and laterally spaced apart from said support wall, having a trailing end disposed in longitudinally spaced apart relation to said transversely disposed wall so that said hot gases execute a second return bend at a trailing end of said longitudinally extending wall, said hot gases being separated from said afterburner passageway during the execution of said second return bend only by said transversely disposed wall.

14. The apparatus of claim 13, wherein said transversely disposed wall is formed of a material having a low resistance to heat transfer to thereby maximize the amount of heat from said afterburner passageway that is transferred to said hot gases during the execution of said second return bend.

15. The apparatus of claim 14, further comprising a warm air chamber disposed in said upper chamber, a wall member separating said warm air chamber from said primary combustion chamber;

said warm air chamber being disposed between an upper half of said afterburner passageway and an upper part of said chimney means.

16. The apparatus of claim 15, further comprising blower means positioned within said warm air chamber for distributing warm air therewithin to preselected parts of said apparatus.

17. The apparatus of claim 16, wherein said preselected parts are said primary combustion chamber, said secondary combustion chamber, and said afterburner passageway.

18. The apparatus of claim 17, further comprising a primary ignition burner in open fluid communication with said cremation chamber, an entrance door positioned at a leading end of said apparatus in registration with said cremation chamber, and interlocking means for interrupting operation of said primary ignition burner when said entrance door is open.

19. The apparatus of claim 18, further comprising a remains removal door positioned in a side wall of said apparatus at a trailing end thereof, said remains removal door being transversely spaced apart from said afterburner passageway.

* * * * *